US009733035B2

(12) United States Patent
Davis

(10) Patent No.: US 9,733,035 B2
(45) Date of Patent: Aug. 15, 2017

(54) RETRACTABLE SUPRESSOR

(71) Applicant: The United States of America as represented by the Secretary of the Navy, Washington, DC (US)

(72) Inventor: Jason M. Davis, Loogootee, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/943,334

(22) Filed: Nov. 17, 2015

(65) Prior Publication Data

US 2016/0290754 A1 Oct. 6, 2016

Related U.S. Application Data

(60) Provisional application No. 62/141,977, filed on Apr. 2, 2015.

(51) Int. Cl.
*F41A 21/30* (2006.01)
*F41A 21/34* (2006.01)

(52) U.S. Cl.
CPC ..... *F41A 21/34* (2013.01); *F41A 21/30* (2013.01)

(58) Field of Classification Search
CPC ..... F41A 21/00; F41A 21/28; F41A 21/30; F41A 21/32; F41A 21/325; F41A 21/34; F41A 21/36; F41A 21/38; F41G 11/003
USPC ..... 42/90, 85, 1.06; 89/14.05, 14.2, 14.3, 89/14.4; 181/223
See application file for complete search history.

(56) References Cited

U.S. PATENT DOCUMENTS 1,111,202 A * 9/1914 Westfall ..... F41A 21/30 181/223
4,203,347 A * 5/1980 Pinson ..... F41A 1/08 89/1.703
4,426,909 A * 1/1984 Carter ..... F41A 21/30 89/1.816
8,857,306 B1 * 10/2014 Edsall ..... F41A 21/30 181/223
8,939,057 B1 * 1/2015 Edsall ..... F41A 21/30 181/223
2015/0362276 A1 * 12/2015 Fischer ..... F41G 11/003 89/14.4

* cited by examiner

*Primary Examiner* — Jonathan C Weber
(74) *Attorney, Agent, or Firm* — Christopher A. Monsey; Eric R. VanWiltenburg

(57) ABSTRACT

A variety of apparatuses and associated methods are provided for providing a retractable suppressor system for gas generator systems such as a firearm. One embodiment includes a suppressor system that includes a retractable structure and housing, a fixed baffle, floating baffles, and springs to displace the floating baffles within the suppressor as the suppressor is extended from the housing along a gas generator system, e.g. a barrel of a firearm and thereby enclose the barrel within the suppressor. Embodiments of the invention permit full retraction, partial retraction/extension, or full extension of an exemplary suppressor with respect to an emission section of the gas generator e.g., firearm muzzle. Embodiments of the invention include an external latch which enables an operator to latch or unlatch the suppressor as it moves from one position to another and prevents accidental activation. Embodiments of the invention are configured to operate with accessory mounting systems.

5 Claims, 6 Drawing Sheets

RETRACTABLE SUPRESSOR

CROSS-REFERENCE TO RELATED APPLICATIONS

The present application claims priority to U.S. Provisional Patent Application Ser. No. 62/141,977, filed Apr. 2, 2015, entitled "RETRACTABLE SUPRESSOR," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,119) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to a sound and muzzle flash suppressor device. In particular, some embodiments of the invention provide one or more improvements or combinations thereof such as, for example, an adjustable and retractable means for suppressing sound and/or muzzle flash from projectile firing apparatuses in a manner that is compatible with accessory equipment mounting structures such as MIL-STD-1913 rail systems, reduces weight from suppressor/mounting systems, reduces difficulty in rapidly manipulating/deactivating the suppressor due to heat, enabling alternate mounting options to the projectile firing apparatus, reducing baffle strikes, provides an improved center of mass for an operator, improves an ability to use the projectile firing device to be maneuvered or used in restricted space environments such as a vehicle or urban environments such as an interior passageway of a structure.

FIG. 1 shows an existing projectile firing apparatus 1 such as a short barreled AR-15 with an existing suppressor 3 mounted on its muzzle brake/flash hider (not shown). In this example, the suppressor 3 is attached directly to a forward end of the projectile firing apparatus 1 at the furthest end of its barrel where the muzzle brake/flash hider is formed. This existing device combination suffers from a variety of disadvantages including inability to rapidly change or remove the suppressor 3 for a variety of reasons including high temperatures after use requiring additional equipment to touch or manipulate the suppressor 3, incompatibility with different types of projectile firing apparatus due to suppressor 3 mounting designs which are design to mount to specific structures such as muzzle brakes/flash hiders thus cannot be reutilized with other projectile firing apparatuses, suppressors out of "tune" with the firing apparatus' motion or force dynamics during interior and intermediate ballistic phases (increasing baffle or suppressor structure strikes), weight disadvantages, difficulty in using in restricted space environments, and center of mass farther way from an operator which increases difficulty in use, among other disadvantages. FIG. 2 shows another projectile firing apparatus with a longer barrel 13 than the FIG. 1 example more clearly showing an existing suppressor 11 being mounted on an end of the longer barrel 13.

One advantage of an embodiment of a retractable suppressor is an ability to conveniently stow the suppressor. In close quarters, such as a vehicle or ship, the suppressor could easily be retracted to conserve space. Such a feature also aids in concealment for concealed or stealthy or operations executed to avoid detection. Another advantage of an embodiment of an exemplary suppressor is that it has no dependence on the muzzle brake/flash hider. Many of the sound suppressors currently on the market use the muzzle brake/flash hider as a mounting surface. As a result, a specific muzzle brake/flash hider must be used with a specific suppressor. An exemplary suppressor allows a use of any desired muzzle brake/flash hider. Also, embodiments of the invention permit variable muzzle lengths. Length affects center of mass of a weapon mounting a suppressor. Depending on accessories used, a shooter may desire to shift that center of mass toward or away them. Unlike other sound suppressors, embodiments of the invention could be used on different caliber weapons, provided, in some cases, a bore restrictor is changed. Unlike many suppressors, which are typically fully-welded units, an exemplary suppressor can easily be disassembled, cleaned, and repaired. Embodiments of the invention enable easy replacement of suppressor chamber springs and/or floating baffles which provide a shooter with design and sustainment alternatives. Depending on weapon system and ammunition type, different chamber springs and floating baffles can be substituted. Due to the space required to accommodate the baffles while the invention is in the retracted position, when extended, that space becomes more volume in which the combustion gases can expand.

A variety of apparatuses and associated methods are provided for providing a retractable suppressor system for gas generator systems such as a firearm. One embodiment includes a suppressor system that includes a retractable structure and housing, a fixed baffle, floating baffles, and springs to displace the floating baffles within the suppressor as the suppressor is extended from the housing along a gas generator system, e.g. a barrel of a firearm and thereby enclose the barrel within the suppressor. Embodiments of the invention permit full retraction, partial retraction/extension, or full extension of an exemplary suppressor with respect to an emission section of the gas generator e.g., firearm muzzle. Embodiments of the invention include an external latch, which enables an operator to latch or unlatch the suppressor as it moves from one position to another and prevents accidental activation. Embodiments of the invention are configured to operate with accessory mounting systems.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
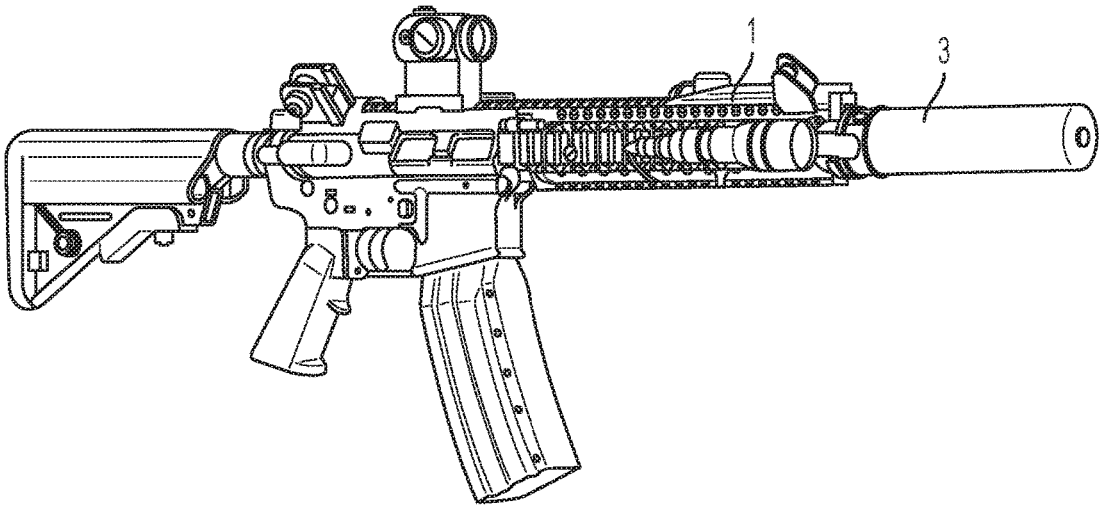
Fig. 1 (Prior Art)
FIG. 1 shows an existing projectile firing apparatus.
Figure 3:
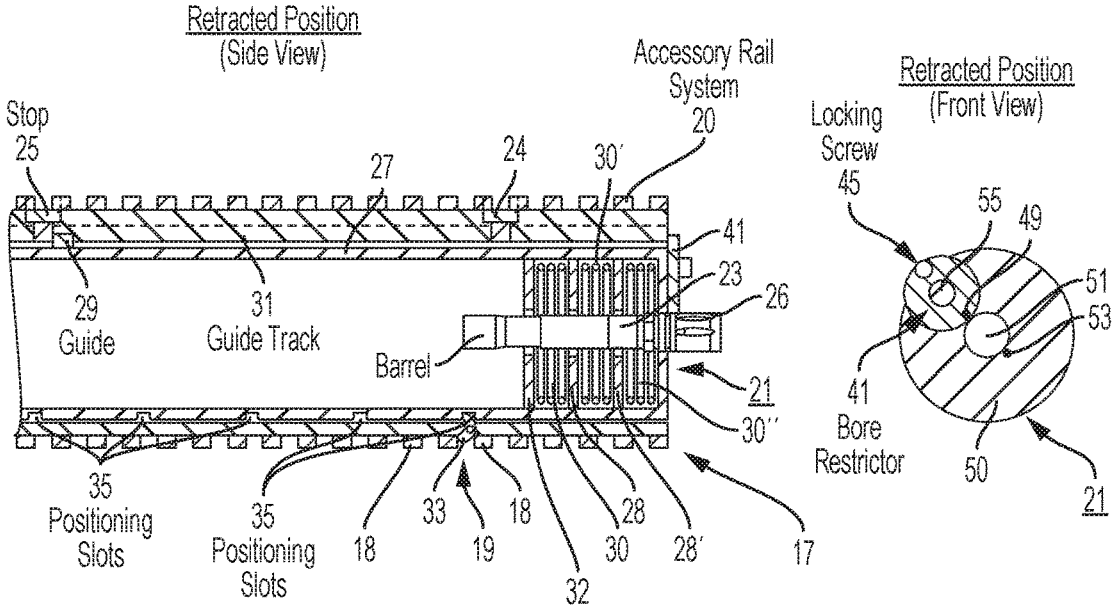
FIG. 3 shows a side cut-away view of an exemplary suppressor assembly having a body in a retracted position.

Referring initially to FIG. 3, a side cut-away view of an exemplary suppressor assembly 21 having a body 27 is shown mounted in a retracted position. An accessory rail structure 20 is provided comprising a plurality of parallel rail protrusions 18 on an outer surface of the accessory rail structure configured to releasably engage with accessory equipment mounting structures (not shown) (e.g., flashlight shown in FIG. 1), said accessory rail structure 20 is formed with a hollow body configured or formed to permit movement of said suppressor 21 laterally along a first axis parallel with an outer wall of a barrel 23 of the firearm (not shown) within said hollow body, the accessory rail structure 20 is formed having a first aperture 17 on a first rail structure end, a mounting structure (not shown) on an opposing second rail structure end configured to mount or couple the accessory rail structure 20 to a section of the firearm surrounding the barrel 23, a guide movement channel/track 31 defining a passage or channel set into or within a lateral section of an interior wall of said accessory rail structure along said first axis running parallel along said interior wall and the outer wall of the barrel 23, a first and second removable and adjustable stop sections 24, 25 respectively disposed on opposing ends of a portion of said guide movement channel/track 31, the stop sections 24, 25 extending into said guide movement channel/track 31 but not protruding past said interior wall surface, a catch mounting and interface section formed into said accessory rail structure 25, a spring loaded catch 33 disposed within said catch mounting and interface section formed with a spring and a latch section (not shown) that is configured to engage with a plurality of indentions, e.g. a plurality of positioning slots 35, into a side of the suppressor body 27 of said suppressor 21 in a retracted position, the spring loaded catch 33 further including a lever protrusion that extends from an outer section of said accessory rail structure that is disposed in a gap 19 between but not extending past two of the rail protrusions 18, wherein the lever protrusion is formed with a knurled surface (not shown) configured to increase friction for manual operation of the latch by an operator of said firearm.

The suppressor 21 is formed with its suppressor body 27 having an outer shape having a first suppressor body end 50 formed with a second aperture 51 formed to permit said barrel 23 to move into and out of said second aperture, that fits within the hollow body of said accessory rail structure 25, a guide 29 formed as a protrusion from the suppressor body 27 configured to slideably engage within the guide movement channel/track 31 between the forward stop 24 the rear stop 25 which arrest movement of the guide 29 in an extended and the retracted position, a plurality of the positioning slots formed into the side of the suppressor body 27, a fixed barrel baffle 32 that has a center aperture that the barrel 23 passes into, the fixed barrel baffle 32 is fixed to and extends away from a section of the outer wall of the barrel 23 and is dimensioned to move with a clearance between an outer end of the fixed barrel baffle 32 and an inner wall of the suppressor 21 body 27, the suppressor 21 further includes a plurality of floating baffles 28, 28' configured with a floating baffle center aperture which slides over the outer wall of the barrel 23, the suppressor 21 further includes a first, second, and third plurality of chamber springs 30, 30', 30" each respectively disposed between the floating baffles 28, 28', the first, second and third plurality of chamber springs 30, 30', 30" are formed and slideably disposed surrounding a section of the outer wall of the barrel 23, wherein the chamber springs 30, 30', 30" are configured to apply pressure against lateral sides of the floating baffles 28, 28' so that when the spring loaded catch 33 is moved and disengages with one of said plurality of positioning slot 35, the chamber springs 30, 30', 30" move and extend the floating baffles 28, 28' within suppressor along said barrel 23 and so are configured to route propellant gasses generated from firing a projectile propellant within the firearm from a muzzle section of said barrel 23 through the floating baffles 28, 28' and thereby to selectively produce a suppressive effect of said propellant gasses, wherein said spring loaded catch 33 is configured to releasably engage with any one of said plurality of positioning slots 35 so as to configure said suppressor to be fixed in a plurality of intermediate positions within said extended and said retracted positions, the suppressor further including a bore restrictor 41 moveably configured to slide over the second aperture 51 when said barrel 23 moves into said suppressor 21 as it extends from said accessory rail structure 20 through said first aperture 17, wherein the bore restrictor 41 is fixed to the first suppressor body end 50 in proximity to the second aperture 51 by a pivot pin 49 so that the bore restrictor 41 slides away from the second aperture 51 to permit the barrel 23 to move into and out of the second aperture 51, said bore restrictor 41 further includes a locking screw or structure 45 which is configured to releasably couple said bore restrictor in a first and second position, wherein said first position configures said bore restrictor 41 does not cover said second aperture 51 and said second position covers said second aperture 51, wherein said bore restrictor 41 further is formed with a third aperture 55 which is formed with a shape that permits a projectile fired out of said firearm to pass from said barrel 23 through said bore restrictor 41 when said bore restrictor 41 is in the second position, the first suppressor body end 50 is further formed with a receiving structure to receive said locking screw or structure 45 when said bore restrictor 41 is in the second position and thereby fix said bore restrictor 41 in said second position.

Figure 2:
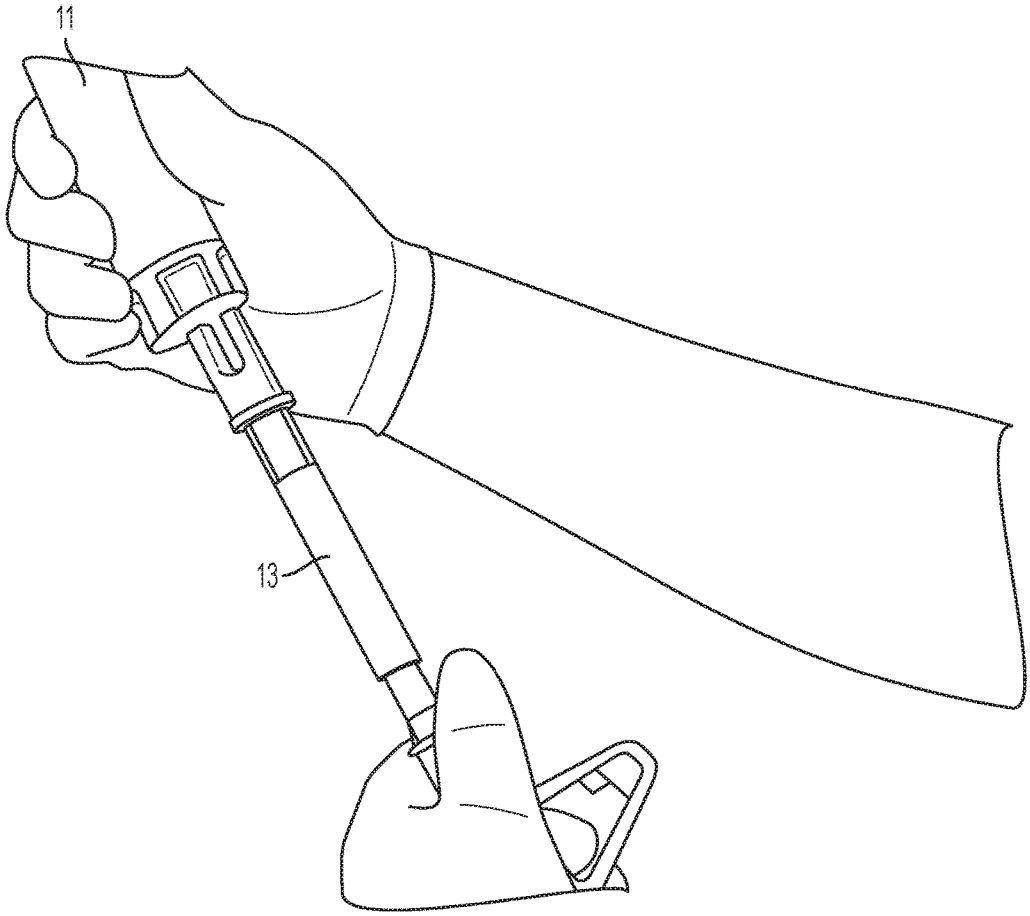
FIG. 2 shows another projectile firing apparatus with a longer barrel.

An exemplary fixed barrel baffle 32 can be configured to attach to a forward location on the barrel 23 of the firearm via a two part clamping mechanism, set screw, pin, or other attachment means commonly used for barrel-mounted accessories, such as used for attaching gas blocks. An exemplary fixed barrel baffle 32 can be attached to the barrel 23 prior to attachment of a muzzle brake/flash hider 26. An actual position of am an exemplary fixed barrel baffle 32 can be determined by selection of a desired location of a muzzle end of the suppressor 21 while in an exemplary retracted position. An exemplary accessory rail system 20 attached to a firearm or a weapon (not shown in FIGS. 3-6 but see FIGS. 1 and 2) can include a guide track 31 that extends from a forward portion to a rear portion of an interior section of an exemplary accessory rail system 20. An exemplary guide track 31 can include a groove on an underside of a MIL-STD-1913 rail (e.g., accessory rail system 20). An exemplary suppressor body 27 can have a guide 29 inserted into an exemplary guide track 31 and then be configured to have an exemplary suppressor 21 slide over an exemplary fixed barrel baffle 32. An exemplary MIL-STD-1913 rail can be configured to accept threaded stops (24, 25) that extend into the guide track 31. Exemplary stops 24, 25 limit rearward and forward travel of the suppressor 21. A hole in a muzzle end of the suppressor 21 can be formed of a sufficient diameter to fit over a muzzle brake/flash hider 26. An embodiment can be formed so contained within a muzzle end of the suppressor 21 are a series of floating baffles (e.g., 28, 28') separated by chamber springs (e.g., 30, 30', 30"). Although the Chamber Springs can be helical coil springs, other types of springs may be used, such as compression wave springs. Chamber springs may be of differing length, depending on desired spacing between floating baffles. A center hole in each floating baffle (not shown) must be of sufficient diameter to fit over the barrel's 23 muzzle brake/flash hider 26. Although depicted as disks, exemplary floating baffles may have a different geometry, such as having concavity. In some embodiments, to retract a suppressor 21, an array of chamber springs (e.g., 30, 30', 30" and floating baffles (e.g., 28, 28') can be compressed, allowing of the plurality of positioning slots 35 on the suppressor 21 to engage the spring loaded catch 19 located on the accessory rail system 20.

Figure 4:
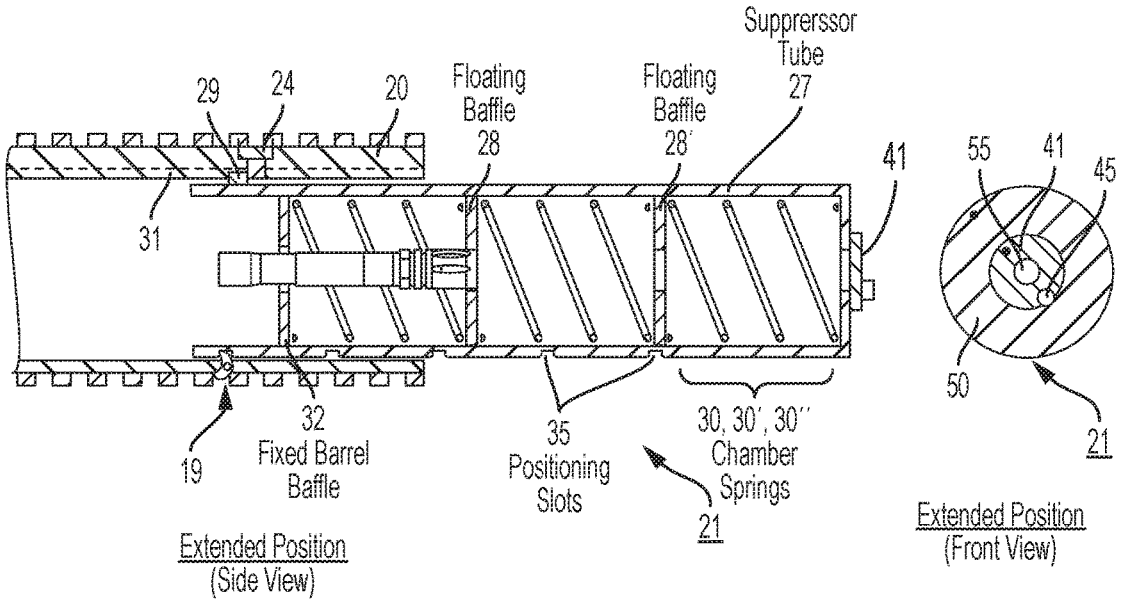
FIG. 4 shows the FIG. 3 embodiment in an extended position.

At a minimum, an embodiment can have two positioning slots 35, one to lock an exemplary suppressor 21 in a fully retracted position (such as shown in FIG. 3) and one to lock the suppressor 21 in a fully extended position (such as shown in FIG. 4). A presence of intermediate positioning slots 35 would allow an exemplary suppressor 21 extension length to vary between fully retracted and fully extended positions. Although an exemplary spring-loaded catch 19 is depicted on an underside of an exemplary accessory rail system 20, it could be located in a variety of locations on an exemplary accessory rail system 20.

An exemplary bore restrictor (e.g., 41) can provide a smaller diameter hole (e.g. 55) for a projectile or bullet to pass through and thus increase suppressive effect and reduce opportunity for foreign objects to enter the suppressor 21. An exemplary bore restrictor 41 can be pinned to a muzzle end of an exemplary suppressor 21, e.g., the first suppressor body end 50 and be secured away from an aperture (e.g. 51) in the suppressor 21 the barrel 23 passes through when an exemplary suppressor 21 is not in an extended position. An exemplary embodiment can include a locking screw (e.g., 45) for use to secure the bore restrictor 41 away from second aperture (e.g., 51) in the first suppressor body end 50.

Referring to FIG. 4, the FIG. 3 embodiment is shown in an extended position showing the suppressor 21 extending away from the accessory rail system 20. The bore retractor 45 is shown in a closed position. The spring-loaded latch 19 is shown engaging with a different positioning slot 35.

Figure 5:
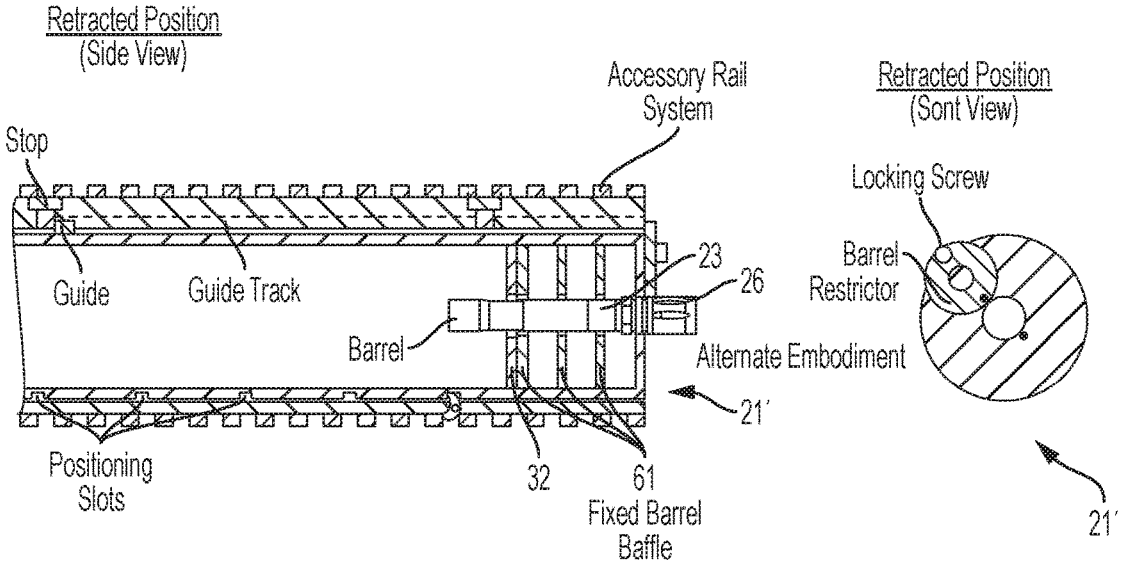
FIG. 5 shows an alternative embodiment of a suppressor in a retracted position.
Figure 6:
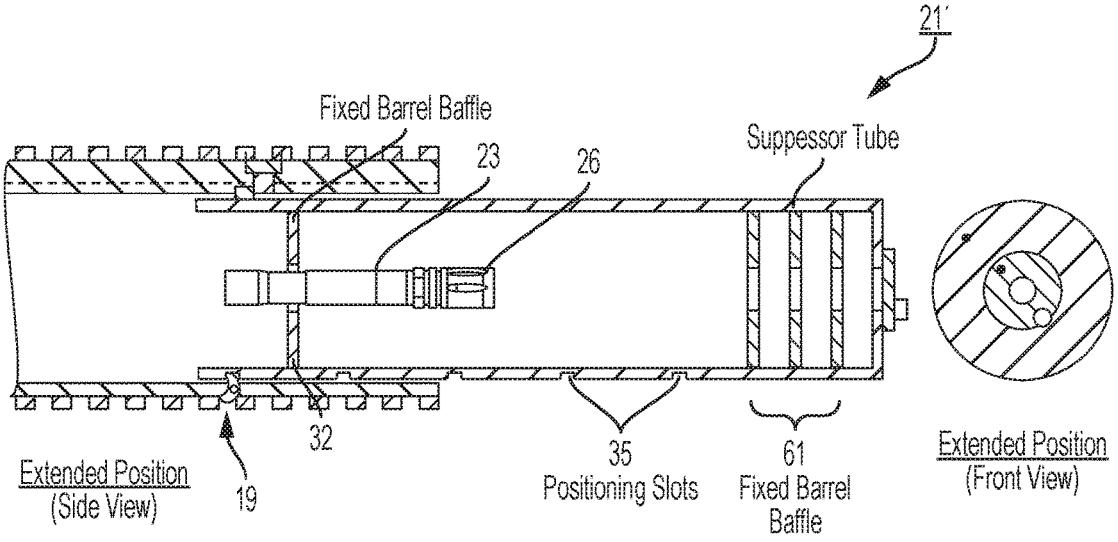
FIG. 6 shows the FIG. 5 embodiment of a suppressor in an extended position.

Referring to FIGS. 5 and 6, an alternate embodiment 21' of this invention could include one without floating baffles and chamber springs. All exemplary baffles 61, with the exception of an exemplary fixed barrel baffle 32, would be fixed with respect to each other and the suppressor 21'.

A method of manufacture for an embodiment of the invention can include providing an embodiment of a firearm (e.g., FIGS. 1, 2 firearm), providing an embodiment of the invention comprising, for example, elements such as described with respect to one or more of FIGS. 3-6, and coupling the embodiment of the invention to the firearm such as shown, e.g., with respect to one or more of FIGS. 3-6.

A method of operation can include providing an embodiment of the invention such as, e.g., described with respect to one or more of FIGS. 3-6, adjusting the suppressor 21 with respect to one of the positioning slots 35 in a fully extended position, an intermediate position, or a fully retracted position, and firing the firearm to fire a projectile from the firearm's barrel 23.

Although the invention has been described in detail with reference to certain preferred embodiments, variations and modifications exist within the spirit and scope of the invention as described and defined in the following claims.

The invention claimed is:

1. A flash suppressor system comprising:

an accessory rail structure and a suppressor structure adapted to insert within said accessory rail structure;

wherein the accessory rail structure comprises a plurality of parallel rail protrusions on an outer surface of the accessory rail structure configured to releasably engage with accessory equipment mounting structures;

a hollow body configured or formed to permit movement of said suppressor laterally along a first axis parallel with an outer wall of a barrel of a firearm within said hollow body, wherein the accessory rail structure is formed having a first aperture on a first rail structure end, a mounting structure on an opposing second rail structure end configured to mount or couple the accessory rail structure to a section of the firearm surrounding the barrel;

a guide movement channel or track defining a passage or channel set into or within a lateral section of an interior wall of said accessory rail structure along said first axis running parallel along said interior wall and the outer wall of the barrel;

a first and second removable and adjustable stop sections respectively disposed on opposing ends of a portion of said guide movement channel or track, the stop sections extending into said guide movement channel or track but not protruding past said interior wall surface;

a catch mounting and interface section formed into said accessory rail structure;

a spring loaded catch disposed within said catch mounting and interface section formed with a spring and a latch section that is configured to engage with a plurality of positioning slots into a side of the suppressor body in a retracted position, said spring loaded catch further including a lever protrusion that extends from an outer section of said accessory rail structure that is disposed in a gap between but not extending past two of the rail protrusions, wherein said spring loaded catch is configured to releasably engage with any one of said plurality of positioning slots so as to configure said suppressor to be fixed in a plurality of intermediate positions within extended and retracted positions;

wherein the suppressor comprises:

a suppressor body having an outer shape having a first suppressor body end formed with a second aperture formed to permit said barrel to move into and out of said second aperture that fits within the hollow body of said accessory rail structure;

a guide formed as a protrusion from the suppressor body configured to slideably engage within the guide movement channel or track between the forward stop and the rear stop which arrests movement of the guide in an extended and the retracted position;

a plurality of the positioning slots formed into the side of the suppressor body in a spaced apart pattern along said first axis;

a fixed barrel baffle that has a center aperture that is formed to receive and permit the barrel to pass into, the fixed barrel baffle is fixed to and extends away from a section of the outer wall of the barrel and is dimensioned to move with a clearance between an outer end of the fixed barrel baffle and an inner wall of the suppressor body;

a plurality of floating baffles configured with a floating baffle center aperture which slides over the outer wall of the barrel;

a first, second and third chamber spring sections each respectively disposed between the floating baffles, wherein said first, second and third chamber spring sections are formed and slideably disposed surrounding a section of the outer wall of the barrel, wherein the chamber springs sections are configured to apply pressure against lateral sides of the floating baffles so that when said spring loaded catch is moved and disengages with one of said plurality of positioning slots, said chamber spring sections move and extend the floating baffles within the suppressor along said barrel in a spaced apart manner and so are configured to route gasses from said gas generator from a muzzle section of said barrel through the floating baffles and thereby to selectively produce a suppressive effect of said gasses;

a bore restrictor moveably configured to slide over the second aperture when said barrel moves into said suppressor as it extends from said accessory rail structure through said first aperture, wherein said bore restrictor further is formed with a third aperture which is formed with a shape that permits a projectile fired out of said firearm to pass from said barrel through said bore restrictor when said bore restrictor is in the second position.

2. A system as in claim 1, further comprising said firearm.

3. A system as in claim 1, wherein the bore restrictor is fixed to the first suppressor body end in proximity to the second aperture by a pivot pin so that the bore restrictor slides away from the second aperture to permit the barrel to move into and out of the second aperture.

4. A system as in claim 3, wherein said bore restrictor further includes a locking screw or structure which is configured to releasably couple said bore restrictor in a first and second position, wherein said first position configures said bore restrictor does not cover said second aperture and said second position covers said second aperture.

5. A system as in claim 4, wherein the first suppressor body end is further formed with a receiving structure to receive said locking screw or structure when said bore restrictor is in the second position and thereby fix said bore restrictor in said second position.

* * * * *